US008487848B2

(12) United States Patent
Lin et al.

(10) Patent No.: US 8,487,848 B2
(45) Date of Patent: Jul. 16, 2013

(54) DRIVING CIRCUIT AND GRAY INSERTION METHOD OF LIQUID CRYSTAL DISPLAY

(75) Inventors: Hsiang-Tan Lin, Keelung (TW); Shih-Chieh Yen, Chiayi County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 665 days.

(21) Appl. No.: 12/337,586

(22) Filed: Dec. 17, 2008

(65) Prior Publication Data

US 2010/0085386 A1 Apr. 8, 2010

(30) Foreign Application Priority Data

Oct. 2, 2008 (TW) ..... 97137962 A

(51) Int. Cl.
*G09G 3/36* (2006.01)

(52) U.S. Cl.
USPC ..... 345/87; 345/98

(58) Field of Classification Search
USPC ..... 345/87, 98, 100
See application file for complete search history.

(56) References Cited

U.S. PATENT DOCUMENTS

| | | | | |
|---|---|---|---|---|
| 7,414,795 | B2 * | 8/2008 | Cok | 359/649 |
| 7,592,981 | B2 * | 9/2009 | Maeda | 345/76 |
| 2005/0174320 | A1 * | 8/2005 | Park | 345/102 |
| 2006/0022984 | A1 * | 2/2006 | Ruggiero | 345/506 |
| 2007/0018934 | A1 * | 1/2007 | Kim et al. | 345/98 |
| 2007/0182700 | A1 * | 8/2007 | Baba et al. | 345/102 |
| 2007/0188428 | A1 * | 8/2007 | Nishiyama et al. | 345/87 |
| 2008/0198107 | A1 * | 8/2008 | Park et al. | 345/84 |
| 2008/0238897 | A1 * | 10/2008 | Kimura | 345/204 |

FOREIGN PATENT DOCUMENTS

| | | |
|---|---|---|
| CN | 101286303 | 10/2008 |
| TW | 200746031 | 12/2007 |

OTHER PUBLICATIONS

"First Office Action of China Counterpart Application", issued on Jan. 20, 2012, pp. 1-5.

* cited by examiner

*Primary Examiner* — Chanh Nguyen
*Assistant Examiner* — Jonathan Blancha
(74) *Attorney, Agent, or Firm* — Jianq Chyun IP Office

(57) ABSTRACT

A driving circuit and a gray insertion method of a liquid crystal display (LCD) are provided. The gray insertion method includes analyzing whether a current frame belongs to a dynamic frame or a static frame. When the current frame belongs to a dynamic frame, charging time of a gray insertion image is extended. When the current frame belongs to a static frame, the charging time of a gray insertion image is shortened. As a result, motion blur on the LCD can be reduced and image quality can be increased.

1 Claim, 6 Drawing Sheets

DRIVING CIRCUIT AND GRAY INSERTION METHOD OF LIQUID CRYSTAL DISPLAY

CROSS-REFERENCE TO RELATED APPLICATION

This application claims the priority benefit of Taiwan application serial no. 97137962, filed on Oct. 2, 2008. The entirety of the above-mentioned patent application is hereby incorporated by reference herein and made a part of this specification.

BACKGROUND OF THE INVENTION

1. Field of the Invention

The present invention relates to a gray insertion technique of a liquid crystal display, and more particularly, to a gray insertion technique adaptively adjusting charging time of a gray insertion image to adjust gray insertion of various levels.

2. Description of Related Art

The liquid crystal display (LCD) adopts a hold-type display method so when the LCD displays a dynamic image, motion blur may occur. In general, a gray insertion technique is conventionally adopted to reduce motion blur. A brief illustration is first provided below on how the LCD panel is driven.

A driving signal for the LCD panel mainly includes two parts, a data signal provided by a source driver and a scan signal provided by a gate driver. The data signal mainly provides a voltage signal corresponding to each pixel gray level. The scan signal is used to control a switch signal input from a voltage of each row of pixels. The scan signal scans row by row. Generally speaking, each pixel includes a thin film transistor comprising a gate, a source, and a drain. The scan signal is used to control the conduction of the thin film transistor. When the thin film transistor is turned on, the data signal may charge a pixel storage capacitor through the thin film transistor.

FIG. 1A is a schematic view of a scan signal when a conventional LCD panel displays a normal image. Referring to FIG. 1A, when scan signals Gate 01~Gate N are at logic high levels, the thin film transistor is turned on and the data signal may charge the pixel storage capacitor through the thin film transistor for displaying a normal image.

FIG. 1B is a schematic view of a scan signal when a conventional LCD panel displays a normal image and a gray insertion image. When the gray insertion function is activated, a frame may be divided into two sections, a normal frame 101 and a gray insertion frame 102. In the gray insertion frame 102, the time when the scan signals Gate 01~Gate N are at logic high levels is fixed.

It should be noted that although the gray insertion technique may improve motion blur of a dynamic image, it may greatly decrease brightness of an image as well. When the LCD displays a static image such as a photograph or text image, motion blur does not occur. If the gray insertion technique is used in the LCD during the display of a static image, it results in low image contrast.

Therefore, when the LCD displays a static image, the gray insertion function is manually turned off in the conventional technology. However, turning on and off the gray insertion function results in significant variance in the brightness level of the display image and hence causes great discomfort to the human eye.

SUMMARY OF THE INVENTION

The present invention provides a gray insertion method of a liquid crystal display which may adjust various levels of gray insertion according to changes in the display images so as to promote image quality.

From another aspect, the present invention provides a driving circuit capable of analyzing a current frame to accordingly adjust charging time of a gray insertion image such that the problems of motion blur as well as low brightness are improved.

The present invention provides a gray insertion method of a liquid crystal display including analyzing whether a current frame belongs to a dynamic frame or a static frame. Furthermore, when the current frame belongs to a dynamic frame, charging time of a gray insertion image is extended. When the current frame belongs to a static frame, the charging time of a gray insertion image is shortened.

In one embodiment of the present invention, the abovementioned step of analyzing whether the current frame belongs to a dynamic frame or a static frame includes retrieving a previous frame of the current frame. In addition, when the current frame differs from the aforesaid previous frame, the current frame is determined to be a dynamic frame. When the current frame is the same as the aforesaid previous frame, the current frame is determined to be a static frame.

In one embodiment of the present invention, the abovementioned step of analyzing whether the current frame belongs to a dynamic frame or a static frame includes retrieving a previous frame of the current frame. In addition, a difference value is generated based on the current frame and the previous frame. When the difference value is larger than a preset value, the current frame is determined to be a dynamic frame. When the difference value is not larger than the preset value, the current frame is determined to be a static frame. In another embodiment, the abovementioned step of generating the difference value based on the current frame and the previous frame includes determining whether a first region of the current frame is the same as a first region of the previous frame. Furthermore, a determination of whether a second region of the current frame is the same as a second region of the previous frame is made. Next, the difference value is determined based on a number of differences between the corresponding regions of the current frame and the previous frame.

In one embodiment of the present invention, the abovementioned step of analyzing whether the current frame belongs to a dynamic frame or a static frame includes calculating a number of continuous changes of the current frame and a plurality of previous frames. When the number of continuous changes is larger than a preset value, the current frame is determined to be a dynamic frame. When the number of continuous changes is not larger than the preset value, the current frame is determined to be a static frame.

In one embodiment of the present invention, as in the above descriptions, when the current frame belongs to a dynamic frame, the step of extending the charging time of a gray insertion image includes using a maximum charging time as the charging time of a gray insertion image when the extended charging time of a gray insertion image exceeds above the maximum charging time. In addition, a minimum charging time is used as the charging time of a gray insertion image when the shortened charging time of a gray insertion image falls below the minimum charging time.

The present invention provides a driving circuit. The driving circuit includes a controller and a driver. The controller may analyze whether a current frame belongs to a dynamic frame or a static frame. The driver is coupled to the controller. When the current frame belongs to a dynamic frame, charging time of a gray insertion image may be extended by the driver. When the current frame belongs to a static frame, the charging time of a gray insertion image may be shortened by the driver.

In one embodiment of the present invention, the driving circuit further includes a video decoder and a frame buffer. The video decoder is coupled to the controller. The frame buffer is coupled to the video decoder as well as the controller and may store a previous frame of the current frame. When the current frame differs from the previous frame, the controller determines that the current frame is a dynamic frame. When the current frame is the same as the previous frame, the controller determines that the current frame is a static frame.

In one embodiment of the present invention, the driving circuit further includes a video decoder and a frame buffer. The video decoder is coupled to the controller. The frame buffer is coupled to the video decoder as well as the controller and may retrieve a previous frame of the current frame. The controller may analyze a difference value between the current frame and the previous frame. When the difference value is larger than a preset value, the controller determines that the current frame is a dynamic frame. When the difference value is not larger than a preset value, the controller determines that the current frame is a static frame. In another embodiment, the abovementioned controller may include a counter. The counter is coupled to the video decoder as well as the frame buffer and may calculate a number of different corresponding regions between the current frame and the previous frame and use the calculated value as the abovementioned difference value.

In one embodiment of the present invention, the driving circuit further includes a video decoder, a frame buffer, and a counter. The video decoder is coupled to the controller. The frame buffer is coupled to the video decoder and the controller. The counter is coupled to the controller. When two continuous images are different from each other, a count value of the counter is accumulated; when two continuous images are the same as each other, the count value of the counter is reset. When the count value is larger than a preset value, the controller may determine that the current frame is a dynamic frame; when the count value is not larger than the preset value, the controller may determine that the current frame is a static frame.

The present invention may analyze whether a current frame belongs to a dynamic frame or a static frame. When the current frame belongs to a dynamic frame, charging time of a gray insertion image is extended. When the current frame belongs to a static frame, the charging time of a gray insertion image is shortened. Therefore, quality of display images may be promoted.

To make the aforesaid features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

A conventional gray insertion method may improve motion blur of a dynamic image but may significantly reduce brightness of a dynamic image and a static image. In addition, turning on and off the gray insertion function results in significant variance in the brightness level of the display image and hence causes great discomfort to the human eye.

In light of the above, embodiments of the present invention provide a gray insertion method of an LCD. The method may analyze whether a current frame is a dynamic frame or a static frame. After the analysis is completed, if the current frame is a dynamic frame, charging time of a gray insertion image may be gradually extended so as to improve motion blur. In contrast, if the current frame is a static frame, the charging time of a gray insertion image may be gradually shortened so as to improve low brightness level of a display image. Furthermore, the abovementioned gradual control of the length of the charging time of a gray insertion image may also prevent a sudden variation of brightness of a display image and thus reduce discomfort to the human eye when the gray insertion function is suddenly turned on. Illustrations on embodiments of the present invention are described below with reference to the accompanied figures provided for the purpose of explaining the exemplary embodiments of the present invention, wherein same numerals denote same or similar elements or steps.

Figure 1A:
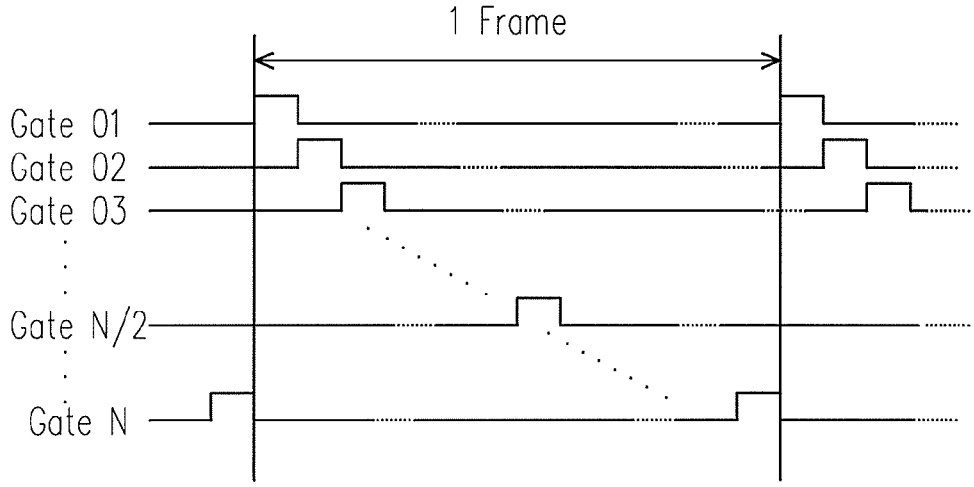
FIG. 1A (PRIOR ART)
FIG. 1A is a schematic view of a scan signal when a conventional LCD panel displays a normal image.
Figure 1B:
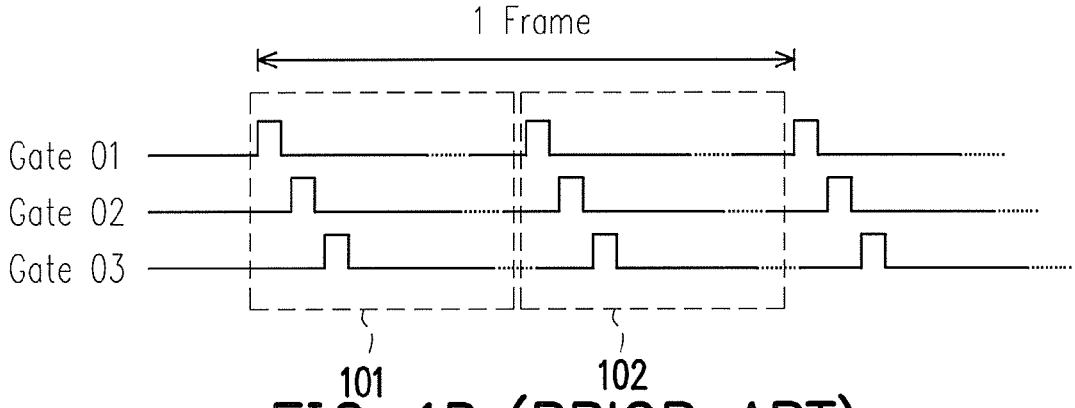
FIG. 1B (PRIOR ART)
FIG. 1B is a schematic view of a scan signal when a conventional LCD panel displays a normal image and a gray insertion image.
Figure 1C:
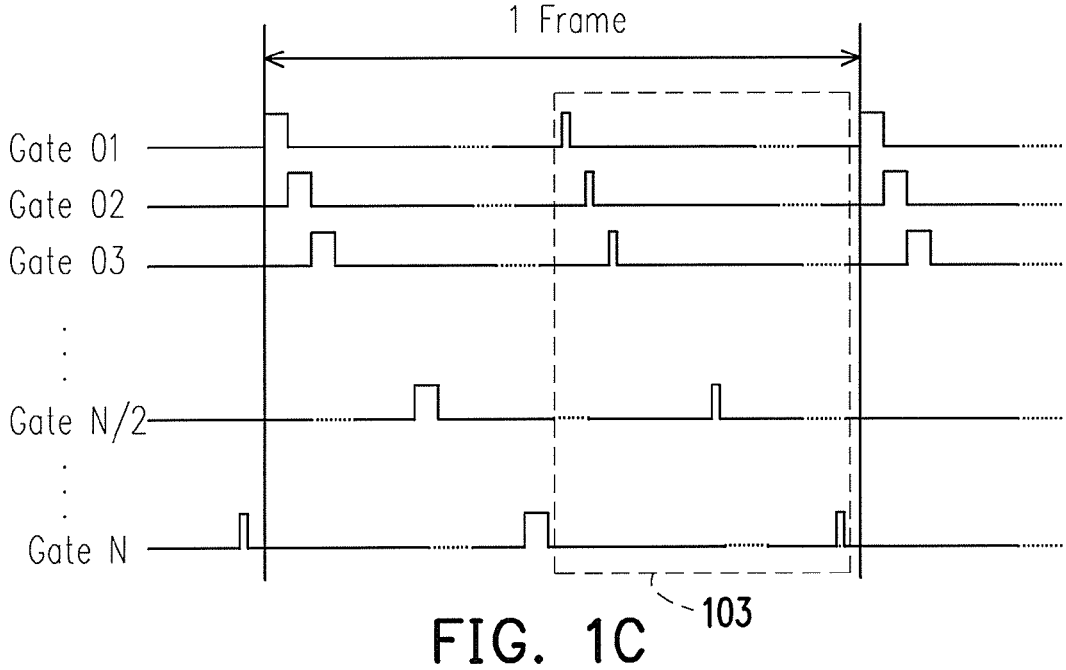
FIG. 1C is a schematic view illustrating adjustment of charging time of a gray insertion image based on the image according to one embodiment of the present invention.

FIG. 1C is a schematic view illustrating adjustment of charging time of a gray insertion image based on the image according to one embodiment of the present invention. Referring to FIG. 1C, the gray insertion method of the present embodiment may analyze whether a current frame belongs to a dynamic frame or a static frame. When the current frame belongs to a dynamic frame, the charging time of a gray insertion image 103 (i.e. the time when scan signals Gate 01~Gate N are at logic high levels) may be gradually extended. As such, motion blur may be improved.

When the current frame belongs to a static frame, the charging time of a gray insertion image may be gradually shortened. In other words, the time when the scan signals Gate 01~Gate N are at logic high levels may be adjusted to be shorter so that charging time of a source gray insertion signal to an image is insufficient, the image will not appear too dark, and thus brightness of the image may be maintained.

Figure 2:
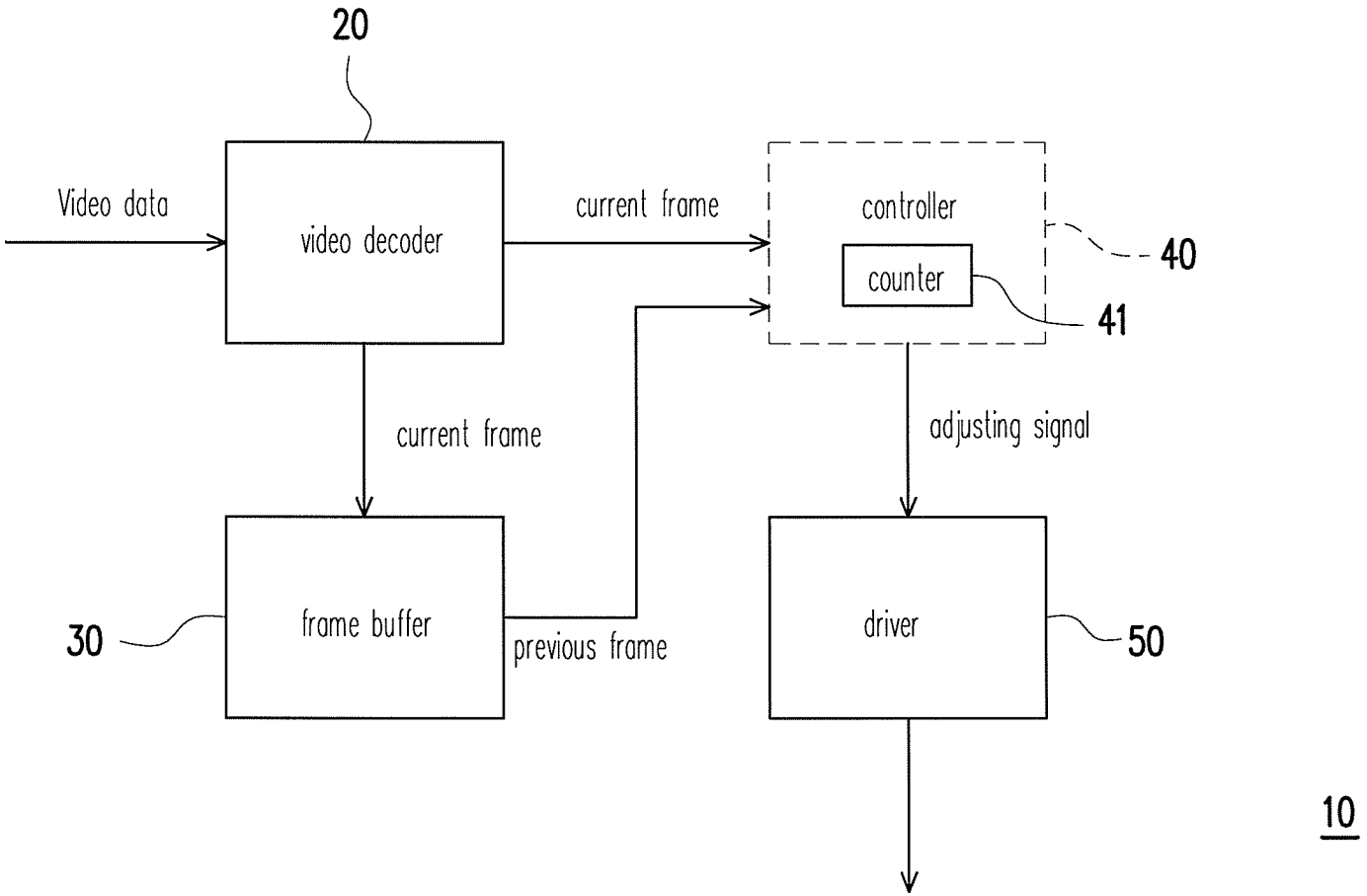
FIG. 2 is a block diagram of a driving circuit according to one embodiment of the present invention.

FIG. 2 is a block diagram of a driving circuit according to one embodiment of the present invention. Referring to FIG. 2, in the present embodiment, a driving circuit 10 may include a video decoder 20, a frame buffer 30, a controller 40, and a driver 50. In addition, the controller 40 may include a counter 41. In the present embodiment, the controller 40 is coupled to the driver 50. The video decoder 20 is coupled to the controller 40. The frame buffer 30 is coupled to the video decoder 20 and the controller 40. The counter 41 is coupled to the video decoder 20 and the frame buffer 30.

The video decoder 20 may be used to decode video data and accordingly provide decoded frame to the controller 40 and the frame buffer 30. The frame buffer 30 may be used to store a frame and provide a pervious frame to the controller 40. The controller 40 may analyze whether the current frame belongs to a dynamic frame or a static frame based on the current frame provided by the video decoder 20 and the previous frame provided by the frame buffer 30 so as to generate an adjusting signal. Next, the driver 50 may adjust the charging time of a gray insertion image according to the adjusting signal.

More specifically, in a first frame period, the video decoder 20 may provide a first frame to the controller 40 and the frame buffer 30. The frame buffer 30 may store the first frame. Next, in a second frame period, the video decoder 20 may provide a second frame to the controller 40 and the frame buffer 30. The frame buffer 30 may output the first frame to the controller 40 and store the second frame. The controller 40 may analyze whether the second frame belongs to a dynamic frame based on the first frame provided by the frame buffer 30 and the second frame provided by the video decoder 20 so as to generate the adjusting signal. As such, the driver 50 may adjust the charging time of a gray insertion image in the second frame period according to the adjusting signal. An illustration is described below in association with a flowchart.

Figure 3:
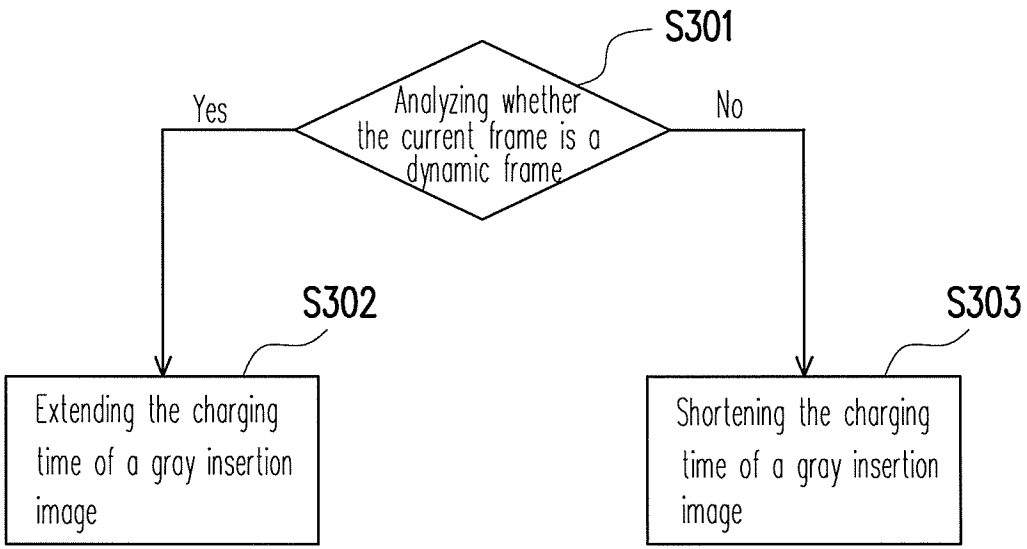
FIG. 3 is a flowchart of a gray insertion method of an LCD according to one embodiment of the present invention.
Figure 4:
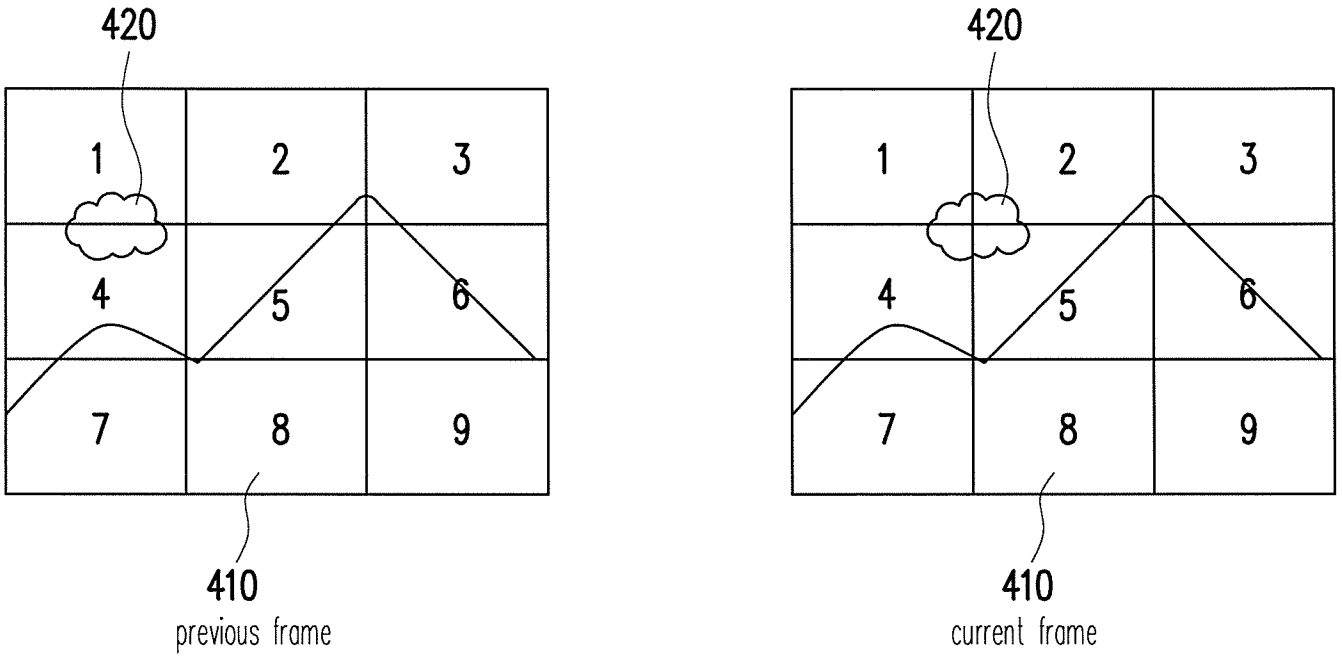
FIG. 4 is a schematic view of a previous frame and a current frame.

FIG. 3 is a flowchart of a gray insertion method of an LCD according to one embodiment of the present invention. FIG. 4 is a schematic view of a previous frame and a current frame. Simultaneously referring to FIG. 2~FIG. 4, suppose the previous frame and the current frame are continuous frames, wherein the previous frame and the current frame both contain a mountain 410 and a cloud 420 with only a difference in the positions of the cloud 420. Furthermore, suppose the frame buffer 30 has stored the previous frame. When the video decoder 20 provides the current frame to the frame buffer 30 and the controller 40, the frame buffer 30 may store the current frame and provide the previous frame to the controller 40. On the other hand, the controller 40 may analyze whether the current frame belongs to a dynamic frame (step S301) based on the current frame and the previous frame. If the current frame is a dynamic frame, step S302 is performed; otherwise, step S303 is carried out. An embodiment of step S301 is described below for reference of persons skilled in the art.

Figure 5:
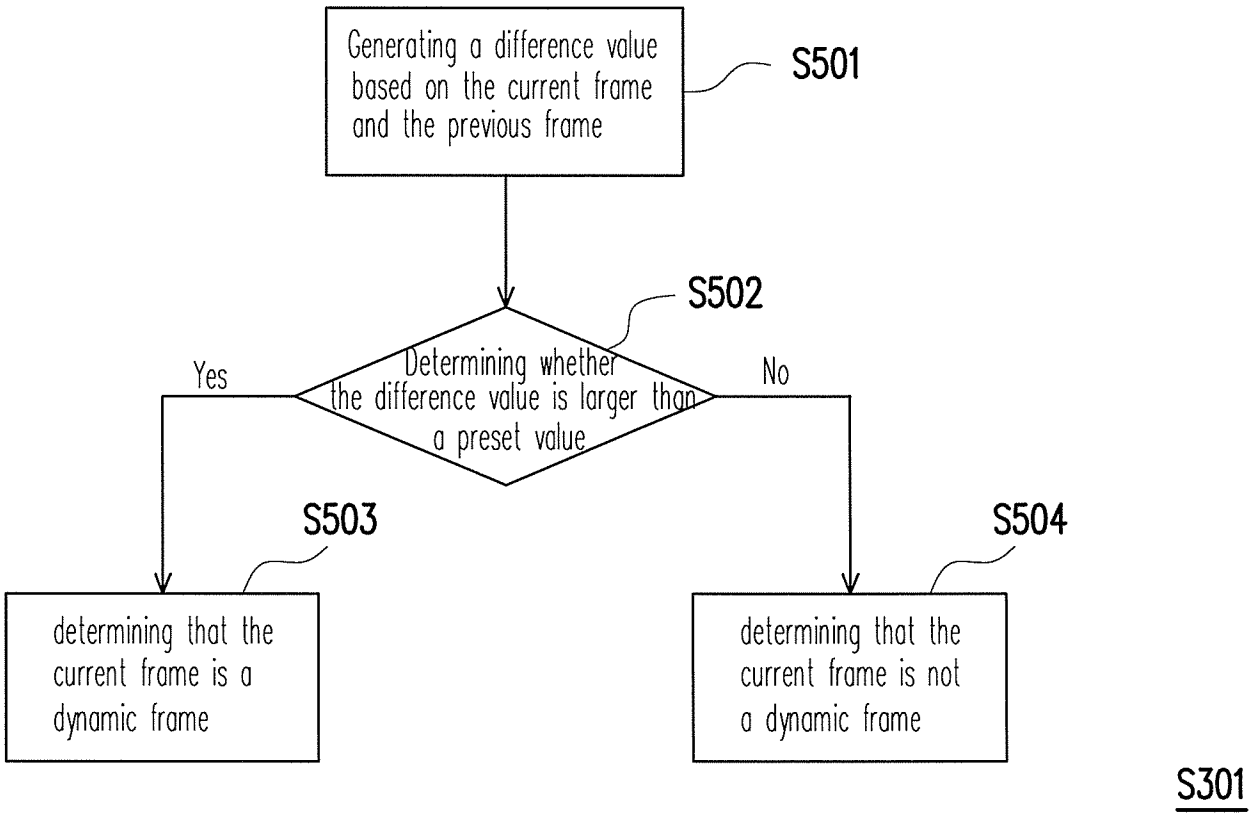
FIG. 5 is a flowchart of one embodiment of step S301.

FIG. 5 is a flowchart of one embodiment of step S301. Simultaneously referring to FIG. 2~FIG. 5, step S301 in the present embodiment may include steps S501~S504. First, a difference value is generated based on the current frame and the previous frame in step S501. For example, a comparison may be made on whether corresponding regions between the current frame and the previous frame are the same. Next, the difference value is generated based on a number of the corresponding regions that are different from each other.

More specifically, in the present embodiment, the counter 41 may first reset its count value with an initial value of zero. Then, the controller 40 may first compare whether a region 1 of the previous frame is the same as a region 1 of the current frame. The counter 41 performs no action if the region 1 of the previous frame is the same as the region 1 of the current frame; otherwise, the counter 41 accumulates the count value. In the present embodiment, the region 1 of the previous frame is not the same as the region 1 of the current frame so the count value changes from 0 to 1. Similarly, the controller 40 then respectively compares whether regions 2~9 of the previous frame are the same as regions 2~9 of the current frame. In the present embodiment, the regions 2, 4, and 5 of the previous frame are not the same as the regions 2, 4, and 5 of the current frame so the count value becomes 4 after the controller 40 completes the comparison of the regions 2~9 of the previous frame with the regions 2~9 of the current frame. It should be noted that the count value in the present embodiment may be directly used as the abovementioned difference value, which is not limited by the present invention herein. In other embodiments, the count value may be indirectly used as the abovementioned difference value.

Step S502 is then performed after the difference value is obtained. The controller 40 may determine whether the difference value is larger than a preset value. If the difference value is larger than the preset value, the controller determines that the current frame is a dynamic frame (step S503); otherwise, the controller determines that the current frame is not a dynamic frame (i.e. a static frame) (step S504). In the present embodiment, the preset value is 4 for the purpose of illustration. Therefore, the difference value is not larger than the preset value. The controller 40 determines that the current frame is a static frame and accordingly generates, for the driver 50, an adjusting signal which may shorten the charging time of a gray insertion image.

It should be noted that the present embodiment uses steps S501~S504 to implement step S301, which has the advantage that frames with minor changes are not determined as dynamic frames.

Step S303 (i.e. shortening the charging time of a gray insertion image) is then performed because the current frame is determined as a static frame in step S301. Simultaneously referring to FIG. 1C, and FIG. 2~FIG. 5, in step S303, the driver 50 may shorten the charging time of a gray insertion image in FIG. 1C based on the adjusting signal provided by the controller 40. As such, the charging time of a gray insertion image may be gradually shortened and hence the problem of low brightness of an LCD displaying a static frame may be improved. Furthermore, discomfort to the human eye resulted from the significant variance in brightness due to the great change in the charging time of a gray insertion image may be avoided.

It should be further noted that a minimum charging time is used as the charging time of a gray insertion image when the shortened charging time of a gray insertion image (period b) falls below the minimum charging time. Persons skilled in the art may set the minimum charging time according to requirements. The advantage lies in that an LCD may continuously display gray insertion images.

Similarly, step S302 (i.e. extending the charging time of a gray insertion image) is then performed if the current frame is determined as a dynamic frame in step S301. More specifically, in step S302, the driver 50 may extend the charging time of a gray insertion image in FIG. 1C based on the adjusting signal provided by the controller 40. As such, the charging time of a gray insertion image may be gradually extended and hence the problem of motion blur of an LCD displaying a dynamic frame may be improved. Furthermore, discomfort to the human eye resulted from the significant variance in brightness due to the great change in the charging time of a gray insertion image may be avoided.

It should be further noted that a maximum charging time is used as the charging time of a gray insertion image when the extended charging time of a gray insertion image (period b) exceeds above the maximum charging time. Persons skilled in the art may set the maximum charging time according to requirements. The advantage lies in that an LCD may continuously display normal images.

It should particularly mentioned that persons skilled in the art may adopt various image scan methods to display the gray insertion image based on requirements after extending or shortening the charging time of a gray insertion image. For example, the driving circuit 10 in the present embodiment may display the gray insertion image in connection with a raster scanning method. However, in other embodiments, an interlace scanning method or other scanning method may be adopted to display the gray insertion image, which is not limited by the present invention herein.

Referring to FIG. 5 again, in step S501 of the above embodiment, a comparison on the nine corresponding regions of the current frame and the previous frame is made to determine whether they are the same so as to generate a difference value, which is not limited by the present invention. In other embodiments, persons skilled in the art may adopt any number of corresponding regions according to requirements in place of the abovementioned nine corresponding regions so as to generate a difference value. Similar effects as those in the abovementioned embodiments may be achieved in this way. The accuracy of the determination that whether the current frame is a dynamic frame will be higher as the number of the corresponding regions increases.

Although the above embodiment has disclosed a possible type of a liquid crystal display and a gray insertion method thereof, it is common sense to persons of ordinary knowledge in this art that different manufacturers may develop different designs of liquid crystal displays and gray insertion methods thereof, and the application of the present invention should not be limited to this type only. In other words, any method including an analysis of whether a current frame is a dynamic or static frame so as to accordingly determine whether to extend or shorten charging time of a gray insertion image falls within the spirit of the present invention. Some other embodiments are further discussed hereinafter to allow persons of ordinary skill in the art to comprehend and embody the present invention.

In addition, in the above embodiment, the block diagram of the LCD disclosed in FIG. 2 is merely an exemplary embodiment, which is not limited by the present invention herein. In other embodiments, persons skilled in the art may also modify the structure of the driving circuit 10 according to requirements. For example, the counter 41 is disposed in the controller 40 in the embodiment of FIG. 2. However, in other embodiments, the counter 41 may also be disposed outside the controller 40.

In addition, in the above embodiment, steps S501~S504 disclosed in FIG. 5 is merely an exemplary embodiment of step S301, which is not limited by the present invention herein. In other embodiments, persons skilled in the art may also adopt other methods to determine whether the current frame is a dynamic frame (step S301). For example, a direct comparison between the current frame and the previous frame may be made to determine whether they are the same. If the current frame and the previous frame are the same, the current frame is determined to be a static frame; otherwise, the current frame is determined to be a dynamic frame. The advantage of the aforesaid method lies in the simple calculation and that the counter 41 of FIG. 2 may be saved.

Figure 6:
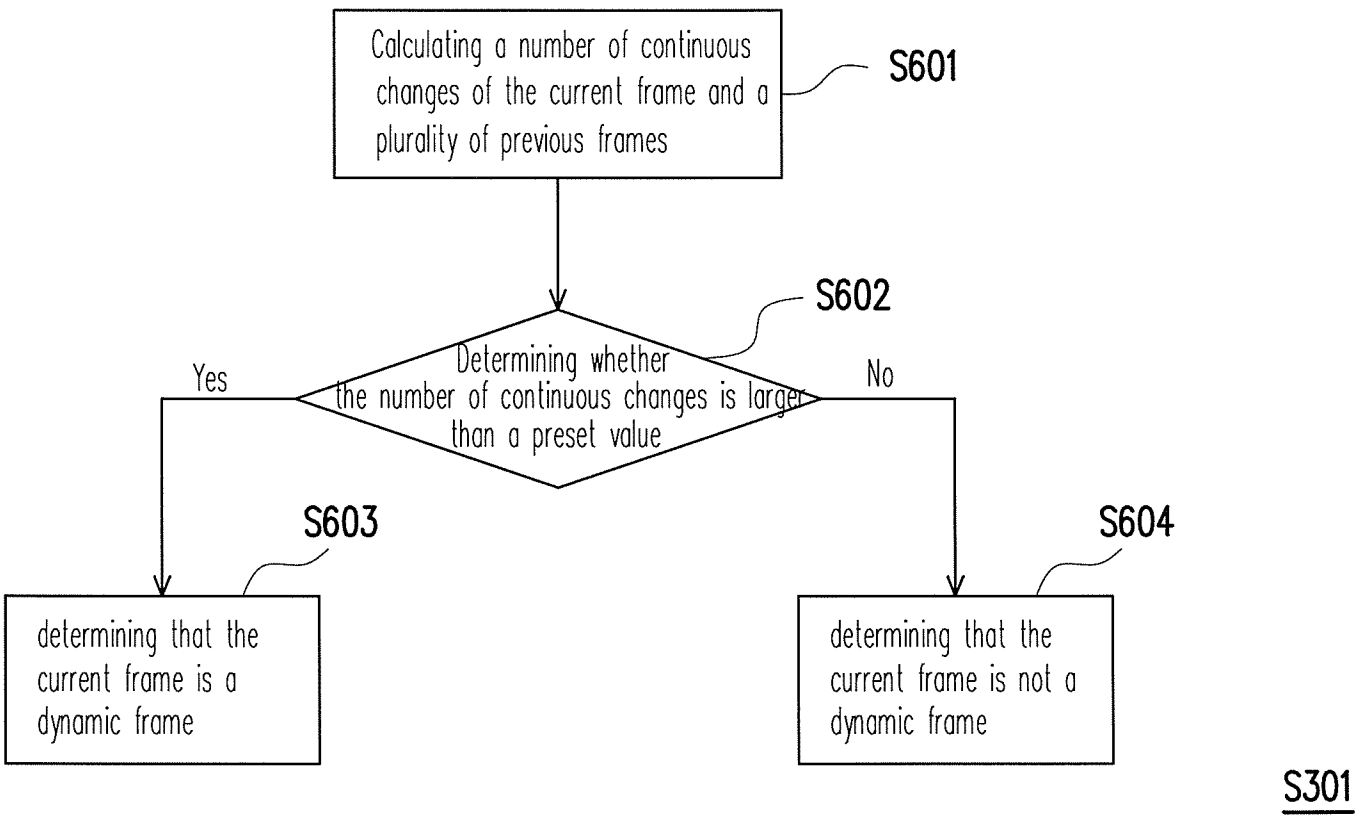
FIG. 6 is a flowchart of another embodiment of step S301.

For example again, FIG. 6 is a flowchart of another embodiment of step S301. Simultaneously referring to FIG. 2~FIG. 6, step S301 in the present embodiment may include steps S601~S604. The present embodiment assumes the initial state of the count value of the counter 41 to be 0. First, in step S601, a number of continuous changes of the current frame and a plurality of previous frames is counted. More specifically, in a first frame period, the controller 40 may check whether the previous frame and the current frame are the same. If they are the same, the counter 41 may reset the count value; otherwise, the counter 41 accumulates the count value. In the present embodiment, the count value of the counter 41 may be used as the abovementioned number of continuous changes. The previous frame and the current frame are assumed to be the same herein so the count value changes from 0 to 1.

Step S602 is performed next to determine whether the number of continuous changes is larger than a preset value. If the number of continuous changes is larger than the preset value, the current frame is determined to be a dynamic frame (step S603); otherwise, the current frame is determined to be a static frame (step S604). The preset value is 3, for example, in the present embodiment. The count value is 1, which is not larger than the preset value 3, so the current frame is determined to be a static frame in the first frame period (step S604).

Similarly, in a second frame period, the abovementioned steps S601~S604 may be followed to determine whether the current frame in the second frame period is a dynamic frame. Persons skilled in the art may deduce from the above descriptions the implementation method of determining whether the current frames in subsequent frame periods are dynamic frames, which is not further illustrated herein.

It should be noted that the present invention uses steps S601~S604 to implement step S301, which has the advantage that frames with no changes in a short time are not determined as static frames. Furthermore, although the frame buffer 30 of the present embodiment may only store one frame, information of a plurality of previous frames may be indirectly obtained in the present embodiment by integrating the use of the counter 41. It is not required to store a plurality of previous frames and therefore storage space of the frame buffer 30 may effectively be saved.

Furthermore, in the present embodiment, the preset value in step S602 is 3 for the purpose of illustration, which is not limited by the present invention herein. In other embodiments, persons skilled in the art may decide on the preset value according to requirements. It should be noted that the current frame is more likely to be determined as a static frame with a larger preset value. In contrast, the current frame is more likely to be determined as a dynamic frame with a smaller preset value.

In summary, the present invention analyzes whether a current frame is a dynamic frame or a static frame through a controller so as to extend or shorten charging time of a gray insertion image. Consequently, the charging time of a gray insertion image may be adaptively adjusted to improve not only motion blur of a dynamic frame but also the loss of brightness of a static frame due to gray insertion. In addition, the embodiments of the present invention further provide the following features:

1. Charging time of a gray insertion image is shortened so the problem of low brightness when an LCD displays a static frame is improved.
2. Charging time of a gray insertion image is extended so the problem of motion blur when an LCD displays a dynamic frame is improved.
3. Charging time of a gray insertion image is gradually adjusted so discomfort to the human eye due to overly high variation in brightness of the image is avoided.
4. Steps S501~S504 are used to implement step S301 so that a current frame is not determined as a dynamic frame merely due to minor changes.
5. A number of corresponding regions is adjusted in step S501 so that accuracy of determining whether a current frame is a dynamic frame may be changed.
6. A direct comparison is made to determine whether the current frame and the previous frame are the same so as to determine whether the current frame is a dynamic frame, which effectively reduces complexity of calculation and saves hardware cost of a counter.

7. Steps S601~S604 are used to implement step S301 so that a current frame with no changes in a short period is not determined as a static frame.
8. Information of a plurality of previous frames may be indirectly obtained through the use of a frame buffer in association with a counter. Storage space of the frame buffer may thus be effectively saved.
9. In step S602, a determination of whether a current frame is likely a dynamic frame may be adjusted by modifying the preset value.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving circuit, comprising:

a controller, analyzing whether a current frame belongs to a dynamic frame or a static frame;

a driver, coupled to the controller, extending charging time of a gray insertion image when the current frame belongs to a dynamic frame, and shortening the charging time of a gray insertion image when the current frame belongs to a static frame;

a video decoder, coupled to the controller;

a frame buffer, coupled to the video decoder and the controller; and a counter, coupled to the controller, wherein a count value of the counter is accumulated when two continuous images are different from each other, the count value of the counter is reset when two continuous images are the same as each other, the controller determines that the current frame is a dynamic frame when the count value is larger than a preset value, and the controller determines that the current frame is a static frame when the count value is not larger than the preset value.

* * * * *